US009080809B2

(12) United States Patent
Umeno

(10) Patent No.: US 9,080,809 B2
(45) Date of Patent: Jul. 14, 2015

(54) COOLING DEVICE WITH A FAN, A PARTITION AND A MULTIPLE AIR FLOW COLLIDING APERTURE IN THE PARTITION FOR DEFROSTING PURPOSES

(75) Inventor: Yoshihisa Umeno, Shimonoseki (JP)

(73) Assignee: KOGASANGYO CO., LTD., Yamaguchi (JP)

( * ) Notice: Subject to any disclaimer, the term of this patent is extended or adjusted under 35 U.S.C. 154(b) by 1825 days.

(21) Appl. No.: 10/529,154

(22) PCT Filed: Jun. 18, 2004

(86) PCT No.: PCT/JP2004/008914
§ 371 (c)(1),
(2), (4) Date: Mar. 24, 2005

(87) PCT Pub. No.: WO2004/113806
PCT Pub. Date: Dec. 29, 2004

(65) Prior Publication Data

US 2006/0162372 A1 Jul. 27, 2006

(30) Foreign Application Priority Data

Jun. 23, 2003 (JP) ..... 2003-178501

(51) Int. Cl.

| | |
|---|---|
| ***F25D 17/06*** | (2006.01) |
| ***F25D 17/04*** | (2006.01) |
| ***F25D 17/00*** | (2006.01) |
| ***A47F 3/04*** | (2006.01) |
| ***F25B 47/00*** | (2006.01) |

(Continued)

(52) U.S. Cl.
CPC ..... *F25D 21/04* (2013.01); *F25D 17/062* (2013.01); *F25D 17/067* (2013.01); *F25D 2317/0662* (2013.01); *F25D 2317/0672* (2013.01); *F25D 2317/0681* (2013.01); *F25D 2500/02* (2013.01)

(58) Field of Classification Search
USPC ..... 62/180, 186, 256, 278, 336, 407, 419, 62/426; 415/211.2; 416/169 A; 219/400
See application file for complete search history.

(56) References Cited

U.S. PATENT DOCUMENTS 2,747,381 A * 5/1956 Lazar ..... 62/336
2,957,067 A * 10/1960 Scofield ..... 219/400

(Continued)

FOREIGN PATENT DOCUMENTS

CN 1060349 4/1992
CN 1179532 4/1998

(Continued)

*Primary Examiner* — Allen Flanigan
*Assistant Examiner* — Filip Zec
(74) *Attorney, Agent, or Firm* — Hamre, Schumann, Mueller & Larson, P.C.

(57) ABSTRACT

A cooling device of the present invention, includes: a cooler provided on at least one side-wall side of a chamber formed with a thermal insulating box; a cooling chamber in front of the cooler; and a fan that allows air in the cooling chamber to flow. The cooler and the cooling chamber are partitioned by a partition so as to allow cold air to be accumulated in the cooler, the fan is disposed on a side of the cooler relative to the partition, the partition in front of the fan has an aperture, and cold air accumulated in a space inside the partition and hot air in the cooling chamber are exchanged by the fan through the aperture. Thereby, a cooling device with a simple configuration and excellent cooling performance can be provided, by which the amount of frost deposited on a cooling coil can be reduced and the miniaturization of the device can be realized.

9 Claims, 4 Drawing Sheets

(51) Int. Cl.

| | |
|---|---|
| ***F25D 25/00*** | (2006.01) |
| ***F03D 11/00*** | (2006.01) |
| ***F04D 29/00*** | (2006.01) |
| ***F25D 21/04*** | (2006.01) |

(56) References Cited

U.S. PATENT DOCUMENTS

| | | | | | |
|---|---|---|---|---|---|
| 2,993,349 | A | * | 7/1961 | Detwiler | 62/256 |
| 3,359,751 | A | * | 12/1967 | Stevens | 62/186 |
| 3,365,118 | A | * | 1/1968 | Winfield, Jr. | 415/211.2 |
| 3,379,029 | A | * | 4/1968 | King | 62/180 |
| 3,759,053 | A | * | 9/1973 | Swaneck, Jr. | 62/157 |
| 4,044,570 | A | * | 8/1977 | Ono et al. | 62/419 |
| 4,144,720 | A | * | 3/1979 | Subera et al. | 62/256 |
| 4,420,679 | A | * | 12/1983 | Howe | 219/400 |
| 5,076,070 | A | * | 12/1991 | Takushima et al. | 62/426 |
| 5,157,935 | A | * | 10/1992 | Gregory | 62/278 |
| 5,775,125 | A | * | 7/1998 | Sakai et al. | 62/410 |
| 5,819,552 | A | * | 10/1998 | Lee | 62/407 |
| 5,941,087 | A | * | 8/1999 | Lee | 62/256 |
| 5,987,904 | A | * | 11/1999 | Kim et al. | 62/131 |
| 6,029,470 | A | * | 2/2000 | Joo et al. | 62/408 |
| 6,055,820 | A | * | 5/2000 | Jeong et al. | 62/186 |
| 6,119,468 | A | * | 9/2000 | Seok | 62/89 |
| 6,381,982 | B1 | * | 5/2002 | Kim | 62/407 |
| 6,427,455 | B1 | | 8/2002 | Furubayashi | |
| 6,579,063 | B2 | * | 6/2003 | Stairs et al. | 416/169 A |
| 6,584,799 | B2 | * | 7/2003 | Jung et al. | 62/419 |
| 6,619,045 | B1 | * | 9/2003 | Clark | 62/3.6 |
| 7,118,333 | B2 | * | 10/2006 | Takemoto | 415/211.2 |

FOREIGN PATENT DOCUMENTS

| | | |
|---|---|---|
| DE | 44 20 149 | 12/1995 |
| EP | 0 478 122 | 4/1992 |
| JP | 55-26306 | 8/1978 |
| JP | 58-88579 | 5/1983 |
| JP | 62-169988 | 7/1987 |
| JP | 62-245069 | 10/1987 |
| JP | 63-140276 | 6/1988 |
| JP | 6-273030 | 9/1994 |
| JP | 3366977 | 11/2002 |
| KR | 2003-0028952 | 4/2003 |
| WO | 98/08035 | 2/1998 |
| WO | 02/16843 | 2/2002 |
| WO | 2005/124249 | 12/2005 |

* cited by examiner

COOLING DEVICE WITH A FAN, A PARTITION AND A MULTIPLE AIR FLOW COLLIDING APERTURE IN THE PARTITION FOR DEFROSTING PURPOSES

TECHNICAL FIELD

The present invention relates to a cooling device to cool materials by circulating cold air with a cooling fan. Specifically, the present invention relates to a cooling device used for freeze-storing foodstuff.

BACKGROUND ART

In cooling devices such as freezers, a forced cold air circulating system is used for cooling. According to the forced cold air circulating system, air cooled by a cooling coil is forced to circulate by a cooling fan in a cooling chamber. Therefore, this system has the advantages of: the cooling chamber having less inner temperature irregularity; and the cooling time being shortened.

For example, in a refrigerator-freezer described in JP S62 (1987)-169988 A, a cooler and a fan are disposed on a rear face of a freezing chamber, and circulation air from a cooling chamber and the freezing chamber, which is sucked through an inlet port provided at a portion below the freezing chamber, passes through the cooler to be subjected to heat exchange, and then is discharged into the freezing chamber with air blown by the fan. In such a forced cold air circulating system, during the heat exchange by the cooler, moisture contained in the circulation air is solidified, which results in frost being deposited on the cooler. The invention according to JP S62 (1987)-169988 A is devised so that the circulation air from the cooling chamber and the circulation air from the freezing chamber join with each other before reaching the cooler, thus reducing the amount of frost deposited on the cooler.

Furthermore, in freezers described in JP H6(1994)-273030 A and JP 3366977 B, a cooler is disposed on a rear face of a freezing chamber, and cold air discharged from a fan provided in front of the cooler cools the inside of the chamber. This configuration is not provided with an air course dedicated to introducing circulation air passed through the cooler to the rear of the fan. Furthermore, since the fan is provided in front of the cooler, circulation air heading for the rear of the fan from the freezer is allowed to flow while bypassing the cooler, thus reducing the amount of frost deposited on the cooler.

In the refrigerator-freezer described in JP S62(1987)-169988 A, however, in order to realize one-way air flow in which circulation air from the inside of the chamber is passed through the cooler to be introduced to the fan, a dedicated air course formed with molded articles and the like is required, which results in an increase in the number of components and makes the configuration complicated. Furthermore, this configuration aims to decrease the frost deposited on the cooler caused by the circulation air from the cooling chamber by using a low-temperature air circulating from the freezing chamber, but is incapable of decreasing the frost on the cooler caused by the circulation air from the freezing chamber.

In addition, although the freezers described in JP H6(1994)-273030 A and JP 3366977 B can decrease the amount of frost deposited on the cooler, there is a need to provide the fan in front of the cooler, which means an increase in the depth dimension. Therefore, this configuration is not suitable for the miniaturization and has difficulty in saving space.

DISCLOSURE OF THE INVENTION

In view of the above-stated conventional problems, it is an object of the present invention to provide a cooling device that has a simple configuration and excellent cooling performance and that enables a decrease in an amount of frost deposited on a cooling coil and realizes miniaturization.

The cooling device of the present invention includes: a cooler provided on at least one side-wall side of a chamber formed with a thermal insulating box; a cooling chamber in front of the cooler; and a fan that allows air in the cooling chamber to flow. The cooler and the cooling chamber are partitioned by a partition so as to allow cold air to be accumulated in the cooler, the fan is disposed on a side of the cooler relative to the partition, the partition in front of the fan has an aperture, and cold air accumulated in a space inside the partition and hot air in the cooling chamber are exchanged by the fan through the aperture.

BEST MODE FOR CARRYING OUT THE INVENTION

According to the cooling device of the present invention, a configuration thereof is simpler than a normal forced cold air circulating system and can provide the comparable cooling performance, and moreover an amount of frost deposited on a cooler can be reduced.

In the cooling device of the present invention, preferably, dimensions of the aperture are larger than a diameter of the fan, and when viewing the fan in a direction of a rotation shaft of the fan, the fan is disposed in the aperture and there is an open space outside the fan. With this configuration, the frost deposition on the cooler can be avoided, and cold air accumulated in the partition and hot air in the cooling chamber are exchanged by the fan through the aperture.

Furthermore, rotation of the fan generates a discharged flow of cold air discharged from the cooler to the cooling chamber through the aperture and a sucked flow of cold air sucked from the cooling chamber to the cooler through the aperture, and the discharged flow and the sucked flow collide with each other, thus suppressing a flow speed of the cold air. With this configuration, the frost deposition on the cooler can be avoided.

Furthermore, it is preferable that the rotation of the fan is at such a flow rate that can suppress the frost deposition on the cooler.

Preferably, the fan is disposed above the cooler. With this configuration, there is no need to increase the depth dimension particularly, thus having an advantage in miniaturization.

Furthermore, preferably, the above cooling device includes a plurality of combinations of the fan and the aperture. With this configuration, the cooling performance can be enhanced.

Furthermore, preferably, a slit is formed in the partition at a portion opposed to the cooler or a portion below the cooler. With this configuration, the cooling performance can be adjusted, thus enhancing the flexibility of design.

Furthermore, assuming that an area of the aperture is S and a diameter of the fan is R, the following relationship preferably is satisfied:

$1.5\times\pi(R/2)^2 \leq S \leq 2\times\pi(R/2)^2$. This configuration is suitable for realizing both of the outflow and the inflow of the air through the aperture and the reduction of the flow speed of the discharged flow into the cooling chamber.

Figure 1:
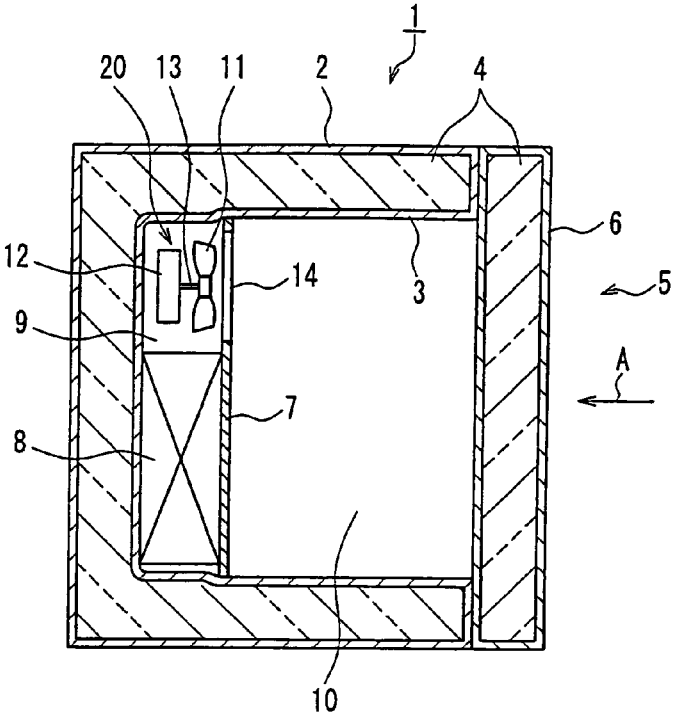
FIG. 1 is a vertical cross-sectional view of a cooling device according to one embodiment of the present invention.

The following describes one embodiment of the cooling device of the present invention, with reference to the drawings. FIG. 1 is a cross-sectional view in the vertical direction (the height direction) of the cooling device according to the present embodiment. A main body 1 of the cooling device is formed by filling a thermal insulator 4 between an outer box 2 and an inner box 3. A door 5 is formed similarly by filling the thermal insulator 4 in a door panel 6.

A space within a thermal insulating box that is formed with the main body 1 and the door 5 of the cooling device is partitioned by a partition 7 into a cooler space 9 on a rear face side and a cooling chamber 10 as a freezing chamber in front of the cooler space 9. In the cooler space 9, a cooler 8 stands. The cooler 8 is a fin-tube type cooling coil, for example. The arrangement of the partition 7 enables the accumulation of cold air in the cooler 8. A fan assembly 20 is disposed above the cooler 8. The fan assembly 20 includes a motor 12 and a fan 11 attached to a rotation shaft 13 of the motor 12.

Although not illustrated, the cooler 8 is connected with a compressor, a condenser, or the like via piping, and a liquid refrigerant supplied from the compressor is evaporated by the cooler 8, and this refrigerant is compressed by the compressor to a high temperature and a high pressure and is liquefied by the condenser, which then is supplied again to the cooler 8.

Although FIG. 1 is a schematic view that does not illustrate the details, a machinery space for installing the afore-mentioned compressor should be provided at a lower portion on a rear face side of the main body 1. The afore-mentioned condenser can be provided so as to contact with the outer box 2 and be embedded in the thermal insulator 4.

Although FIG. 1 illustrates the example of the main body 1 as a freezer, this can be configured by adding a cooling chamber such as a cold room that is separated from a freezing chamber. In this case, cooling components such as a cooler and a fan dedicated for the added cooling chamber may be provided, thus allowing the cooling of the individual chambers separately. In addition, a tray for holding food may be provided in the cooling chamber 10.

Figure 2:
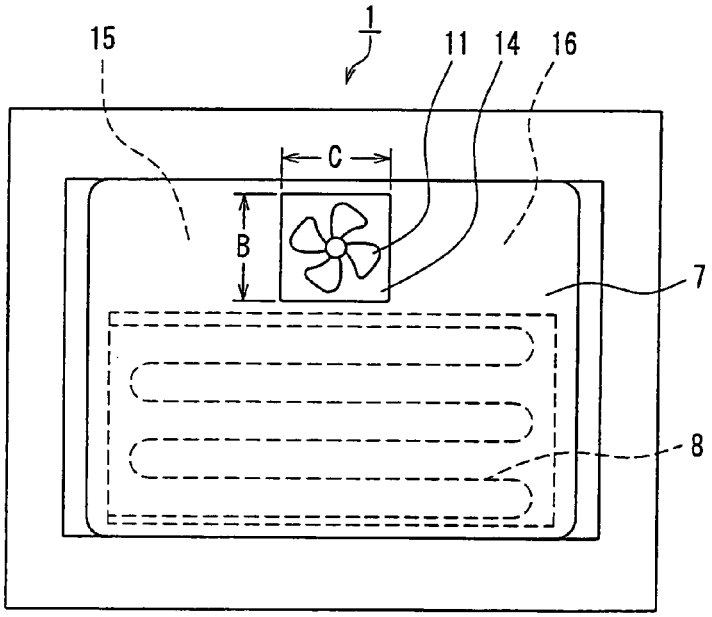
FIG. 2 is a front view of a main body of the cooling device shown in FIG. 1.

FIG. 2 is a front view of the main body 1 shown in FIG. 1, which shows the cooling chamber 10 of FIG. 1 viewed from the direction of arrow A when the door 5 is removed. An aperture 14 of a substantial quadrangle is formed in the partition 7. The lengths of the respective sides of the aperture 14 (dimensions B and C) are made larger than the diameter of the fan.

Figure 3:
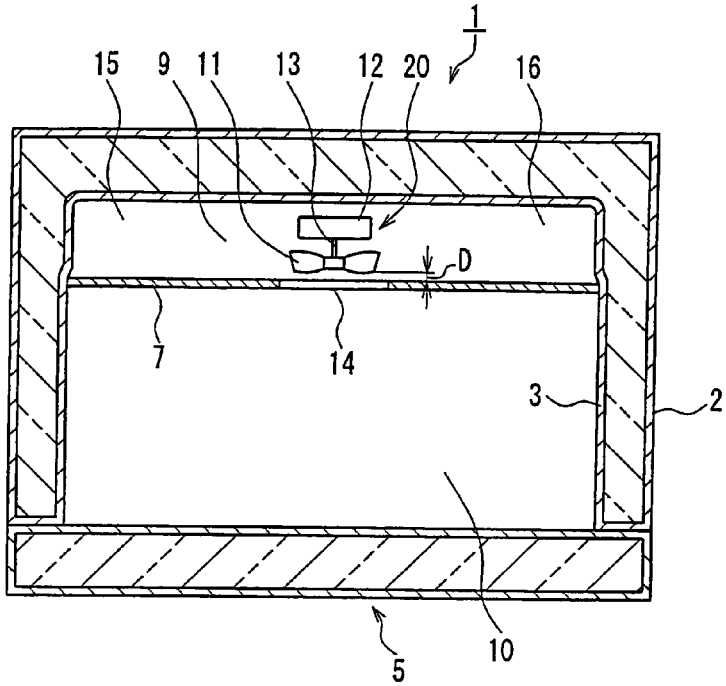
FIG. 3 is a horizontal cross-sectional view of the cooling device shown in FIG. 1.

FIG. 3 is a cross-sectional view in the horizontal direction (the transverse direction) of the cooling device shown in FIG. 1. The fan 11 fits into the cooler space 9. In this illustrated example, the front end portion of the fan 11 is disposed inwardly from the rear face of the partition 7 by the dimension D (the opposite side of the cooling chamber 10). Herein, the front end portion of the fan 11 refers to the front end portion of rotating blade portions of the fan 11 in the rotation shaft direction, and not the front end portion of a boss portion at the center portion of the fan 11.

The fan assembly 20 may be fastened, for example, by attaching a bracket member (not illustrated) holding the motor 12 to the partition 7. Alternatively, the bracket member may be attached to a rear wall surface.

Main components in the cooler space 9 are the cooler 8 and the fan assembly 20, and various attachments, wirings, piping of the respective components further are arranged therein. Any components such as a duct that are dedicated to configuring an air course, through which air flows between the cooler 8 and the fan 11, are not provided. For instance, there is no duct dedicated to introducing air directly to the rear of the fan 11 nor ring portions and cylindrical components surrounding the perimeter of the fan 11. Furthermore, wirings, piping and the like are simply disposed in spaces 15 and 16 that are left and right portions over the cooler 8, and no components dedicated to introducing cold air of the cooler space 9 directly to the fan 11 are provided. Therefore, there is an open space outside the fan 11 in the radial direction.

Figure 4:
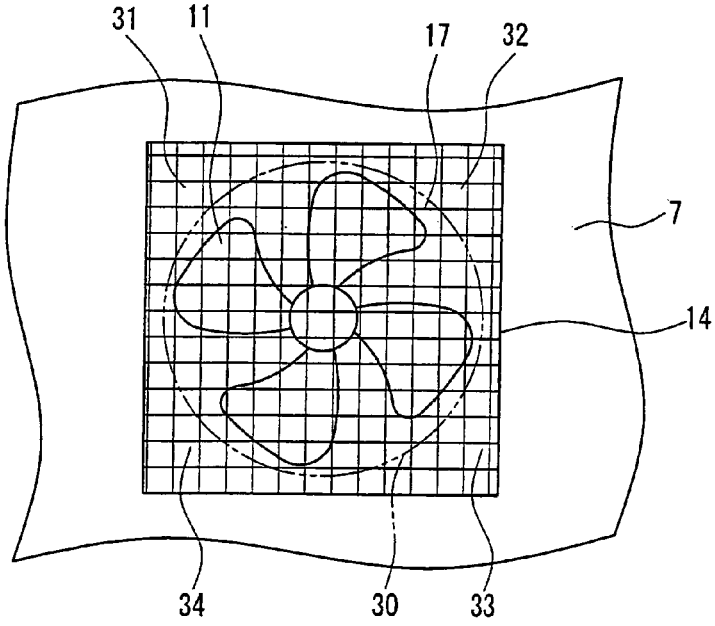
FIG. 4 is a front view of an aperture according to one embodiment of the present invention.

FIG. 4 is a front view of the aperture 14. In this illustrated example, the aperture 14 is covered with a net 17 formed in a mesh structure, thus preventing a human body and a foodstuff from contacting with the fan 11. The net 17 may be fastened to the partition 7 by attaching thereto, or may be formed integrally with the partition 7. Furthermore, the mesh-structured member is not a limiting example, and for example a member with a large number of slits formed therein also is available. Furthermore, the net 17 is not limited to the one substantially coplanar with the partition 7, and the mesh-structured member and the slits may be formed in a three-dimensional member extending toward the side of the cooling chamber 10.

As a specific example of the afore-mentioned cooling device, an exemplary configuration includes Example 1, which will be described later. In Example 1, the internal volume was 168 L, the diameter of the fan 11 was 115 mm, the horizontal dimension (dimension C of FIG. 2) of the aperture 14 was 142 mm, the vertical dimension (dimension B of FIG. 2) of the aperture 14 was 135 mm, and the displacement of the front end of the fan 11 from the partition 7 (dimension D of FIG. 3) was 5 mm. The input power source used was AC 220 V and 60 Hz, the compressor with the output of 422 W was used, and a fan motor with the input power source of DC 12 V and the output of 55 W was used. The refrigerant used was HFC-134a, which was filled in an amount of 165 g.

Figure 5A:
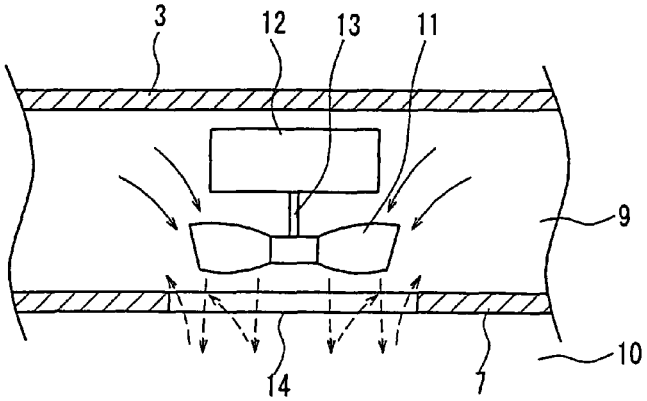
FIG. 5A is a horizontal cross-sectional view of a main portion in the vicinity of a fan of a cooling device according to one embodiment of the present invention.
Figure 5B:
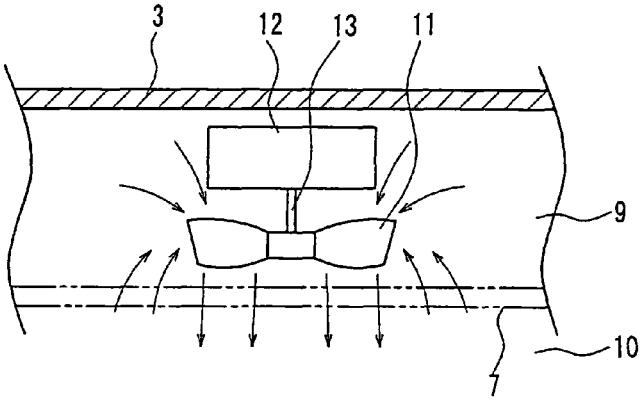
FIG. 5B is a horizontal cross-sectional view of a main portion in the vicinity of a fan of a cooling device according to Comparative Example 1 and FIG. 5C is a horizontal cross-sectional view of a main portion in the vicinity of a fan of a cooling device according to Comparative Example 2.
Figure 5C:
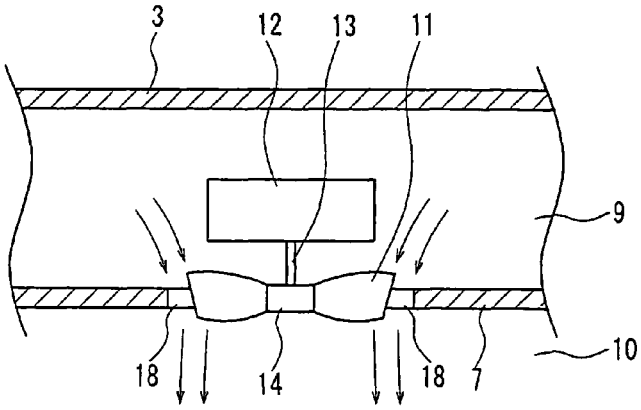

The following describes the operation of the cooling device according to the present embodiment, with reference to FIG. 5. FIG. 5A is a horizontal cross-sectional view of a main portion of the cooling device according to the present embodiment, and FIGS. 5B and 5C are horizontal cross-sectional views of main portions of cooling devices according to Comparative Example 1 and Comparative Example 2, respectively. In the configuration according to FIG. 5B (Comparative Example 1), the partition is terminated at a portion opposed to the cooler 8, and the partition is not arranged at a portion above the cooler 8. Therefore, left and right portions of the fan 11 in the configuration of FIG. 5A form a space sandwiched between the rear wall surface and the partition 7, whereas such a space is not formed in the configuration according to Comparative Example 1 of FIG. 5B.

In the configuration of FIG. 5B (Comparative Example 1), when the fan 11 is rotated in the normal direction so as to introduce the air at the rear of the fan 11 to the front of the fan 11, the air in the cooler space 9 is discharged to the cooling chamber 10 side. Furthermore, the air in the cooling chamber 10 in front of the fan 11 as well as at the rear of the fan 11 is sucked by the rotation of the fan 11 and is discharged to the front of the fan 11.

On the other hand, in the configuration of FIG. 5A, the inner diameter of the aperture 14 is larger than the outer diameter of the fan 11, and the fan 11 is not present in the aperture 14 in the direction of the rotation shaft 13 and the front end of the fan 11 in the direction of the rotation shaft 13 is present within the cooler space 9. Therefore, there is a space in the vicinity of the inner edge of the aperture 14 where the air in the cooling chamber 10 is sucked by a suction force of the fan 11 and flows to the cooler space 9 side.

Thus, in the aperture 14, two-way airflow occurs, one way of which is discharged from the cooler space 9 to the cooling chamber 10 and the other way is sucked from the cooling chamber 10 to the cooler space 9. When the two-way airflow occurs in the limited aperture 14 in this way, a phenomenon as indicated by dashed lines of FIG. 5A occurs in which a discharged flow discharged to the cooling chamber 10 and a sucked flow sucked to the cooler space 9 collide with each other.

Therefore, the airflow does not assume the state as shown in FIG. 5B (Comparative Example 1) in which the discharged flow and the sucked flow are definitely separated, but the discharged flow and the sucked flow collide with each other so as to form a turbulent state, thus reducing the flow speed of the discharged flow to the cooling chamber 10. That is to say, the configuration of FIG. 5A has the effect of reducing the flow speed of the discharged flow to the cooling chamber 10 while allowing the outflow and the inflow of the air through the aperture 14.

FIG. 5C (Comparative Example 2) illustrates a configuration in which an inner edge portion of an aperture 14 is made adjacent to the perimeter of a fan 11. This configuration separately provides an inlet port for sucking the air in a cooling chamber 10 to a cooler space 9 side, and a gap between the perimeter of the fan 11 and the aperture 14 constitutes an air course 18 that introduces the air sucked from the cooler space 9 into the cooling chamber 10. The air course 18 promotes the flow of the air from the cooler space 9 to the cooling chamber 10, and unlike the configuration of FIG. 5A, there is no room for the air in the cooling chamber 10 to flow to the cooler space 9. The same goes for the case where the perimeter of the fan 11 is surrounded with a cylindrical member.

The following describes experimental results for explaining the flow of the air in the configuration of FIG. 5A, with reference to FIG. 4. In the experiment, a freezer (Example 1) was formed to have the configuration similar to that of FIG. 5A, and the flow of the air was confirmed from the movement of smoke and with a small strip piece attached to the net 17 in front of the fan 11. The same confirmation was conducted for the configuration similar to that of FIG. 5B (Comparative Example 1) in which the partition 7 located at the left and right portions over the fan 11 has been removed.

According to Example 1, referring to FIG. 4, a sucked flow as well as a discharged flow was confirmed in a rotation region 30 of the fan 11. At regions 31, 32, 33 and 34 between the perimeter of the fan 11 and the inner edge of the aperture 14 also, a sucked flow and a discharged flow both were present. In these regions, when a small strip piece whose one end was fastened was disposed in the vertical direction, the other end portion swayed back and forth at many positions, in which the flow could not be distinguished clearly between the sucked flow and the discharged flow.

On the other hand, in the configuration (FIG. 5B) in which the partition was not disposed around the fan 11 as in Comparative Example 1, a discharged flow was confirmed at a rotation region of the fan 11 (the region corresponding to the rotation region 30 of FIG. 4), and a sucked flow was confirmed outside of the fan 11, and these flows could be clearly distinguished.

In Example 1, although the discharged flow toward the front of the fan 11 was confirmed, the intensity of the discharge was weakened compared with the configuration of Comparative Example 1 (FIG. 5B). For instance, in Comparative Example 1, it was confirmed that the discharged flow issued intensely from the fan 11 so that the air was discharged to the front face portion (door portion) of the cooling chamber 10. On the other hand, in Example 1, although the discharged flow was confirmed to reach around a central portion of the cooling chamber 10 in the depth direction, the air flow in the discharge direction was not confirmed clearly.

To summarize the above experimental results, it was found that Example 1 allowed the outflow and the inflow of the air through the aperture 14 and allowed the reduction of the flow speed of the discharged flow into the cooling chamber 10. Furthermore, as for the flow of the air in the vicinity of the fan 11, the outflow and the inflow of the air were clearly distinguished in Comparative Example 1, whereas the turbulent state occupied a large area in Example 1.

According to the configuration of the present embodiment, the cold air in the cooling chamber 10 and the cold air accumulated in the cooler space 9 can be exchanged, and therefore the cold air accumulated in the cooler 8 is allowed to flow into the cooling chamber 10 and the hot air heated in the cooling chamber 10 is allowed to circulate to the cooler 8. Therefore, even in the configuration without a dedicated inlet port aside from the aperture 14, the heat exchange was enabled by the cooler 8. From the experiment described later, the freezer according to Example 1 could perform the cooling as a freezer, and the heat exchange by the cooler 8 was performed favorably by the outflow and the inflow of the air through the aperture 14.

If the area of the aperture 14 is too large, the operation would be like that in the case of the configuration of FIG. 5B (Comparative Example 1), thus resulting in the weakening of the effect of reducing the flow speed of the discharged flow. If this area is too small, the effect of allowing the inflow of the air into the cooler space 9 through the aperture 14 would be reduced. Therefore, assuming that the area of the aperture 14 is S and the diameter of the fan 11 is R, it is preferable that the aperture area S is within a range of 1.5 times to 2 times, inclusive, of the area of the fan 11 ($\pi(R/2)^2$) as indicated by the following formula (1):

$$1.5\times\pi(R/2)^2 \leq S \leq 2\times\pi(R/2)^2 \qquad \text{Formula (1)}$$

In Example 1, the aperture area (S) is 19170 $mm^2$ (142 mm×135 mm) and the fan area is 10386.9 $mm^2$ ($\pi\times(115\ mm/2)^2$), and therefore the aperture area S is 1.85 times of the fan area.

In Example 1, the displacement of the front end of the fan 11 from the partition 7 (dimension D in FIG. 3) was 5 mm. This dimension, however, may be within the range of 5 to 30 mm, for example, depending on the diameter of the fan 11.

Figure 6A:
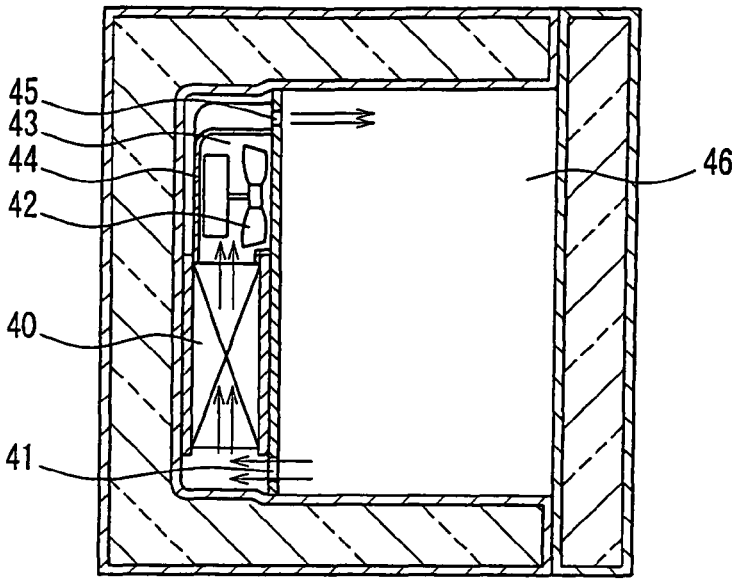
FIG. 6A is a vertical cross-sectional view of a cooling device according to Comparative Example 3 and FIG. 6B is a front view of a portion in the vicinity of a fan of the cooling device shown in FIG. 6A.
Figure 6B:
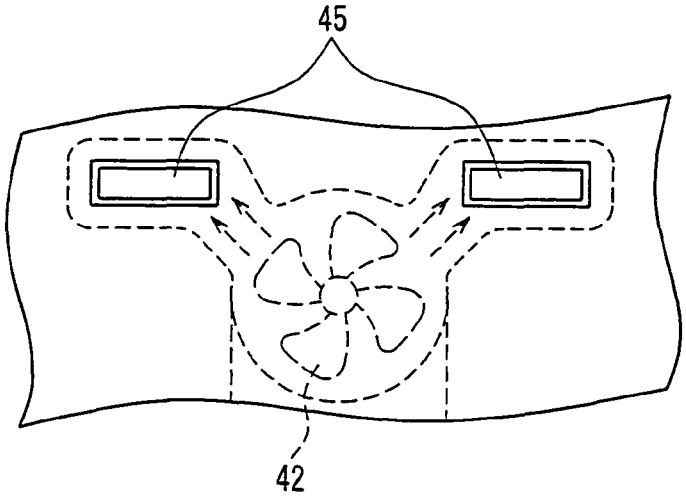

The following specifically describes a comparative experiment for the comparison with a normal forced cold air circulating type freezer. The above-stated Example 1 was used in this comparative experiment. FIG. 6A is a vertical cross-sectional view of a device according to Comparative Example 3 and FIG. 6B is a front view of the same.

The configuration of Comparative Example 3 shown in FIG. 6A is a typical example of the forced cold air circulating system, in which cold air in a cooler 40 sucked from an inlet port 41 located below the cooler 40 flows upward in the cooler 40 and passes through a duct 44 that is disposed to surround a peripheral portion of a fan assembly 43 having a fan 42 to be discharged from an exhaust port 45.

In this configuration, an air course is formed so that the cold air flows in one direction, and therefore the flow of the cold air at the inlet port 41 is directed from a cooling chamber 46 to the cooler 40 and the flow of the cold air at the exhaust port 45 is directed from the cooler 40 to the cooling chamber 46, and the reversed flows of them do not occur.

The main bodies of the devices of Example 1 and Comparative Example 2 had the same configuration, and therefore the volume of their cooling chambers was equal. Furthermore, the portions other than the air course configuration were common to them, and the same components concerning the cooling system such as a cooler, a fan, a fan motor and a compressor were used.

Experimental conditions were made common to each example, where the ambient temperature was 20° C., the relative humidity was 60% and the load in the cooling chamber was 1700 g. As a result of the experiment, in both of Example 1 and Comparative Example 3, it took for about 4 hours to reach a stable state at about −25° C. From this, it was confirmed that Example 1 and Comparative Example 3 were of a substantially equivalent cooling performance.

Note here that although Example 1 and Comparative Example 3 have different air course configurations, they are common in allowing the air to circulate to the cooler and the cold air in the cooler to be discharged to the cooling chamber. Although the flow speed of the cold air reduces and the turbulent state occurs in Example 1, the cooler and the cooling chamber as a whole allow the cold air in the cooler space to be conveyed to the cooling chamber and the cold air in the cooling chamber to circulate to the cooler space, thus enabling the heat exchange in the cooler so as to exert the cooling performance. In the experiment, a difference in temperature between the inlet and the outlet of the cooler (temperature in proximity to the pipe) was about 10° C. at the maximum during the temperature fall and about 4° C. in the stable state, so that sufficient heat exchange could be performed.

Meanwhile, as for the frost deposited on the cooler, the frost was deposited on the entire cooler of Comparative Example 3, whereas only small amount of frost was found at the inlet portion for the refrigerant in Example 1. In Comparative Example 3, when the cold air is heated in the cooling chamber 46, such air passes through the inlet port 41 to reach the cooler 40. Furthermore, the flow speed of the cold air in the cooling chamber 46 is larger than that in Example 1, and the staying time of the cold air in the cooling chamber 46 also is shorter than that in Example 1. Therefore, the cold air in Comparative Example 3 flows in such a manner that the cold air containing moisture in the cooling chamber 46 is conveyed continuously and at a first rate to the cooler 40. Thus, it can be considered that this flow promotes the frost deposition on the cooler 40.

On the other hand, as compared with Comparative Example 3, the cold air in Example 1 flowed gently, and the staying time of the cold air in the cooling chamber 10 was longer than Comparative Example 3. Furthermore, since the cold air discharged from the aperture 14 was sucked to the same aperture 14, a discharged flow and a sucked flow collided with each other in the cooling chamber 10 and joined with each other at a relatively high frequency. Therefore, during the time when the cold air containing moisture stayed gently in the cooling chamber 10, this moisture was solidified in the cooling chamber 10 in some cases. The reduced amount of the frost deposited in Example 1 results from these, and the flow of the cold air in Example 1 can suppress the frost deposition on the cooler 8.

Furthermore, in the present embodiment, since the fan 11 is arranged above the cooler 8 as described above, there is no need to increase the depth dimension particularly, thus having an advantage in miniaturization. Moreover, there is no need to provide a duct dedicated to configuring an air course, through which air flows between the cooler 8 and the fan 11, a duct dedicated to introducing air from the fan 11 to an exhaust port and the like, thus simplifying the configuration and reducing the number of components.

That is to say, according to the present embodiment, the configuration is made simpler than a normal forced cold air circulating system, but a comparable cooling performance can be seen, and moreover the amount of frost deposited on the cooler can be reduced. Therefore, the present embodiment is applicable to a refrigerator, a freezer, a freezing device, a refrigeration device for an automatic vending machine, a cold storage and a freezer car. Furthermore, this embodiment can be applied to both commercial use and home use. Because of the advantage in miniaturization as stated above, this example is effective especially for a freezer and a refrigerator-freezer for home use.

Herein, confirmation by the experiment was conducted also for an example in which a slot-shaped slit perforating through the partition 7 was formed in the partition 7 at a position corresponding to the portion below the cooler 8. As a result of the experiment, there was no specific change found in the basic flow operation of the air at the aperture 14.

This can be considered as follows: that is, in Example 1, the flow of the air at the aperture 14 is not in one direction as stated above, but includes both directions of the outflow and the inflow, and the discharge of the air to the cooling chamber 10 is gentler than in the configuration of Comparative Example 3. This applies to the inside of the cooler space 9 also, and the flow of the air is not in one direction at the portion where the cooler 8 is disposed, and the flow there is gentle. Therefore, it can be considered that even when a slit is formed in the partition 17 at a portion opposed to the cooler 8 or at a portion below the cooler 8, the air does not flow abruptly from the cooling chamber 10 to the cooler space 9 and no specific change occurs in the flow operation of the air at the aperture 14.

The presence or absence of the slit did not affect the basic flow operation of the air at the aperture 14, but the cooling performance was slightly changed. Thus, the cooling performance can be adjusted in accordance with the presence or absence of the slit and the size of the slit, thus enhancing the flexibility of design.

Furthermore, the above description exemplifies one pair of the aperture 14 and the fan 11. However, a plurality of pairs may be provided in order to improve the cooling performance. Furthermore, the example is described where the cooler is provided at the rear face of the thermal insulating box, the cooler may be provided at the side face or at the rear face and the side face.

Furthermore, although the above description exemplifies a quadrangular shape of the aperture 14, the shape is not limited to this, and as long as the diameter of the aperture 14 is larger than the diameter of the fan 11, polygons and a circle other than quadrangles and the shapes similar to these also are available.

Furthermore, although the above description exemplifies the partition 7 constituted with one sheet of plate member, this may be formed by assembling a plurality of members. For instance, a member with the aperture 14 formed therein and a member corresponding to the front face of the cooler 8 may be combined for this purpose.

As stated above, according to the cooling device of the present invention, the configuration is made simpler than a normal forced cold air circulating system, but comparable cooling performance can be obtained, and moreover the amount of frost deposited on the cooler can be reduced.

INDUSTRIAL APPLICABILITY

The cooling device of the present invention is effective for a cooling device used for a freezer for home use, a refrigerator for home use, a freezer for commercial use, a freezer for commercial use, a refrigeration device for an automatic vending machine, a cold storage, a freezer car and an air conditioning system.

The invention claimed is:

1. A cooling device, comprising:

a cooler provided on at least one side-wall side of a main body formed with a thermal insulating box;

a cooling chamber in front of the cooler; and a fan that allows air in the cooling chamber to flow, wherein the cooler and the cooling chamber are partitioned by a partition so as to allow cold air to be accumulated in the cooler, the fan is disposed on a side of the cooler relative to the partition, the partition in front of the fan has an aperture formed in a flat sheet portion, a first open space is formed between the fan and the flat sheet portion in which the aperture is formed, the perimeter of the fan is not surrounded by a cylindrical component, and a second open space is formed outside the fan in the radial direction, cold air accumulated in a space inside the partition and hot air in the cooling chamber are exchanged by the fan through the aperture, and wherein rotation of the fan generates a discharged flow of cold air discharged from the cooler to the cooling chamber through the aperture and a sucked flow of cold air sucked from the cooling chamber to the cooler through the aperture, and the discharged flow and the sucked flow directed from the cooling chamber to the cooler collide with each other in the aperture.

2. The cooling device according to claim 1, wherein dimensions of the aperture are larger than a diameter of the fan.

3. The cooling device according to claim 2, wherein when viewing the fan in a direction of a rotation shaft of the fan, the fan is disposed in the aperture and there is an open space outside the fan.

4. The cooling device according to claim 1, wherein the discharged flow and the sucked flow collide with each other, thus suppressing a flow speed of the cold air.

5. The cooling device according to claim 1, wherein the fan is disposed above the cooler.

6. The cooling device according to claim 1, comprising a plurality of combinations of the fan and the aperture.

7. The cooling device according to claim 1, wherein a slit is formed in the partition at a portion opposed to the cooler or a portion below the cooler.

8. The cooling device according to claim 1, wherein assuming that an area of the aperture is S and a diameter of the fan is R, the following relationship is satisfied:

$$1.5\times\pi(R/2)^2\leq S\leq 2\times\pi(R/2)^2.$$

9. The cooling device according to claim 1, wherein a safety cover is put over the aperture using a net or a slit.

* * * * *